US008327794B2

(12) United States Patent
Pei

(10) Patent No.: US 8,327,794 B2
(45) Date of Patent: Dec. 11, 2012

(54) WET-COATING APPARATUS

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 283 days.

(21) Appl. No.: 12/853,571

(22) Filed: Aug. 10, 2010

(65) Prior Publication Data

US 2011/0253036 A1 Oct. 20, 2011

(30) Foreign Application Priority Data

Apr. 14, 2010 (TW) ..... 99111524 A

(51) Int. Cl.
*B05C 3/09* (2006.01)
*B05C 13/02* (2006.01)

(52) U.S. Cl. ..... 118/429; 118/423; 118/500; 118/66

(58) Field of Classification Search ..... 118/422, 118/423, 429, 500, 503, 50, 326, 66; 427/430.1
See application file for complete search history.

(56) References Cited

U.S. PATENT DOCUMENTS

2005/0048768 A1* 3/2005 Inoue et al. ..... 438/629
2006/0086616 A1* 4/2006 Kurashina et al. ..... 205/83
2006/0234499 A1* 10/2006 Kodera et al. ..... 438/641

* cited by examiner

*Primary Examiner* — Yewebdar Tadesse
(74) *Attorney, Agent, or Firm* — Altis Law Group, Inc.

(57) ABSTRACT

A wet-coating apparatus includes a main body, a cleaning agent bin, a coating agent storage bin, a hot-air injector, a heater, and a transport. The main body defines a coating chamber. The coating chamber includes a first sub-chamber, a second sub-chamber, and a third sub-chamber located between the first and second sub-chambers. The cleaning agent storage bin is received in the first sub-chamber. The coating agent storage bin is received in the first sub-chamber and located adjacent to the third sub-chamber. The hot-air injector is received in the third sub-chamber. The heater is received in the second sub-chamber. The transport is located over the cleaning agent storage bin and the coating agent storage bin, and configured to transport a substrate from the first sub-chamber to the second sub-chamber.

9 Claims, 1 Drawing Sheet

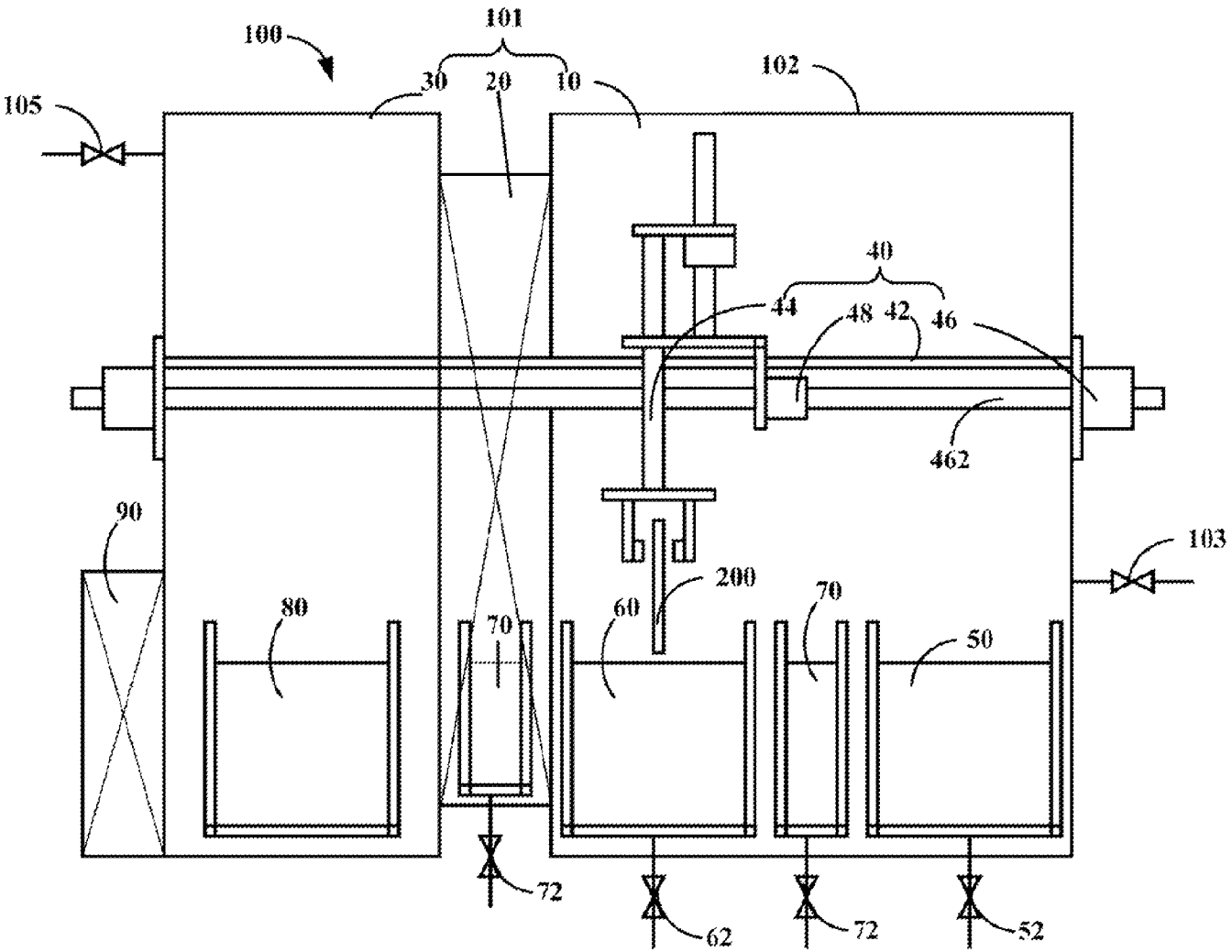
100
101
102
10
20
30
40
42
44
46
48
462
50
52
60
62
70
72
80
90
103
105
200

WET-COATING APPARATUS

BACKGROUND

1. Technical Field

The present disclosure relates to coating apparatuses and, particularly, to a wet-coating apparatus.

2. Description of Related Art

During the process of wet-coating, substrates that need to be coated, need to go through a number of different devices for different sub-processes, such as cleaning, air-drying, coating, and annealing. However, during the transportation of the substrates between the devices, the substrates can be exposed to contaminations and can oxidize, thus, reducing the quality of the wet-coating.

Therefore, it is desirable to provide a new wet-coating apparatus which can overcome the above-mentioned limitations.

BRIEF DESCRIPTION OF THE DRAWING

Many aspects of the present embodiments can be better understood with reference to the following drawing. The components in the drawing are not necessarily drawn to scale, the emphasis instead being placed upon clearly illustrating the principles of the present embodiments.

The FIGURE is a schematic view showing a wet-coating apparatus, according to an embodiment.

DETAILED DESCRIPTION

Embodiments of the present wet-coating apparatus will now be described in detail with reference to the drawing.

Referring to the FIGURE, a wet-coating apparatus 100, according to an embodiment, includes a main body 102, a transport 40, a cleaning agent storage bin 50, a coating agent storage bin 60, two hot-air injectors 70, and a heater 80.

The main body 102 defines a coating chamber 101 that is divided into a low-temperature sub-chamber 10, a high-temperature sub-chamber 30, and an intervening sub-chamber 20, intervening between the low-temperature sub-chamber 10 and the high-temperature sub-chamber 30. The low-temperature sub-chamber 10 is configured for providing a low-temperature environment allowing a substrate 200 to be cleaned and coated therein. The high-temperature sub-chamber 30 is configured for providing an environment allowing the substrate 200 to be annealed therein. The intervening sub-chamber 20 is configured for isolating the low-temperature sub-chamber 10 from the high-temperature sub-chamber 30 to avoid the temperatures of the two sub-chambers 10 and 30 from effecting each other.

The main body 102 also defines an inlet 103 and an outlet 105. The inlet 103 is configured for introducing gases such as noble gas into the coating chamber 101. The outlet 105 is configured for discharging gases from the coating chamber 101.

The chamber 102 also includes an access door 90. The access door 90 is configured for hermetically sealing and closing or opening the coating chamber 101.

The transport 40 includes a rail 42, a mechanical arm 44, a motor 46, and a sliding block 48. The motor 46 includes a lead rod 462. The lead rod 462 is arranged substantially parallel with the rail 42. The moving block 48 is threaded to the lead rod 462 and is slidably coupled to the rail 42. The motor 46 is configured for driving the lead rod 462 to rotate and thus forcing the sliding block 48 to slide along the rail 42. The mechanical arm 44 is secured to the sliding block 48 and thus can slide along the rail 42 along with the sliding block 48. The mechanical arm 44 is configured for holding and moving the substrate 200.

The cleaning agent storage bin 50 is configured for storing a cleaning agent (not shown) such as water and includes a first pipe 52. The first pipe 52 is configured for charging the cleaning agent storage bin 50 with the cleaning agent and discharging the used cleaning agent. In this embodiment, the cleaning agent storage bin 50 is capable of generating ultrasonic waves to facilitate cleaning.

The coating agent storage bin 60 is configured for storing a coating agent (not shown) and includes a second pipe 62. The second pipe 62 is configured for charging the coating agent storage bin 60 with the coating agent and discharging the used coating agent.

The hot-air injectors 70 are configured for injecting hot air and include a supply pipe that connects the hot-air injectors 70 to a hot-air source (not shown).

In assembly, the rail 42 is fixed to the main body 102, running across the low-temperature sub-chamber 10, the intervening sub-chamber 20, and the heating sub-chamber 30. The cleaning agent storage bin 50, one of the hot-air injectors 70, the coating agent storage bin 60, the other hot-air injector 70, and the heater 80 are arranged under the rail 42 and along a sliding direction of the rail 42 from the low-temperature sub-chamber 10 to the high-temperature sub-chamber 30. The cleaning agent storage bin 50 and the coating agent storage bin 60 are received in the low-temperature sub-chamber 10 with one of the hot-air injectors 70 intervened therebetween, wherein the coating agent storage bin 60 is close to the intervening sub-chamber 20 and the cleaning agent storage bin 50 is away from the intervening sub-chamber 20. The other hot-air injector 70 is received in the intervening sub-chamber 20. The heater 80 is received in the high-temperature sub-chamber 30.

In use, the access door 90 is opened and the substrate 200 is placed into the coating chamber 101 and held by the mechanical arm 44. Then the access door 90 is closed and hermetically sealed and the coating chamber 101 is vacuumized by pumping air out of the coating chamber 101 through the outlet 105. After the coating chamber 101 is vacuumized, the motor 46 rotates the lead rod 462 to force the mechanical arm 44 to slide from the low-temperature sub-chamber 10 to the high-temperature sub-chamber 30 along with the sliding block 48.

The mechanical arm 44 stops and moves the substrate 200 into the cleaning agent for cleaning when the substrate 200 approaches the cleaning agent storage bin 50 and moves the substrate 200 away from the cleaning agent after the cleaning is finished and slides along the rail 42 again. Similarly, the mechanical arm 44 stops and moves the substrate 200 to the coating agent for coating when the substrate 200 approaches the coating agent storage bin 60 and moves the substrate 200 away from the coating agent after the coating is finished and slides along the rail 42 again. The mechanical arm 44 stops and moves the substrate 200 toward the hot-air injectors 70 when the substrate 200 approaches the hot-air injectors 70 for air-drying and slides along the rail 42 again after the air-drying has finished. The mechanical arm 44 stops when the substrate 200 approaches the heater 80 for annealing and slides along the rail 42 again to the accessing door 90.

As such, the processes of cleaning, air-drying, coating, and annealing can be finished in one vacuumized coating chamber 101. Oxidization of the substrate 100 is avoided.

During the processes of cleaning, air-drying, coating, and annealing, noble gas such as nitrogen gas is supplied to the coating chamber 101 through the inlet 103 and used noble gas is discharged through the outlet 105. As such, the ambient environment in which the processes cleaning, air-drying, coating, and annealing are carried out is more stable.

It will be understood that the above particular embodiments and methods are shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. A wet-coating apparatus, comprising:

a main body defining a coating chamber, the coating chamber comprising a low-temperature sub-chamber, a heating sub-chamber, and an intervening sub-chamber located between the low-temperature sub-chamber and the heating sub-chamber;

a transport comprising a rail, a sliding block and a mechanical arm, the rail being located across the low-temperature sub-chamber, the intervening sub-chamber, and the heating sub-chamber, the sliding block being slidably coupled to the rail, and the mechanical arm being positioned on the sliding block;

a cleaning agent storage bin received in the low-temperature sub-chamber;

a coating agent storage bin received in the low-temperature sub-chamber and located adjacent to the intervening sub-chamber;

a first hot-air injector received in the intervening sub-chamber; and a heater received in the heating sub-chamber;

wherein the cleaning agent storage bin, the coating agent storage bin, the hot-air injector, and the heater are arranged under the rail.

2. The wet-coating apparatus of claim 1, wherein the main body defines an inlet and an outlet, the inlet is configured for introducing gas into the coating chamber, the outlet is configured for discharging gas from the coating chamber.

3. The wet-coating apparatus of claim 1, wherein the main body comprises an accessing door, the accessing door is configured for hermetically closing or opening the coating chamber.

4. The wet-coating apparatus of claim 1, wherein the transport comprises a motor and a lead rod, the lead rod is arranged in parallel with the rail, the sliding block is threadedly coupled to the lead rod, the motor is configured for rotating the lead rod to force the sliding block to slide along the rail.

5. The wet-coating apparatus of claim 1, wherein the cleaning agent storage bin comprises a pipe, the pipe is configured for charging a cleaning agent into and discharging the cleaning agent from the cleaning agent storage bin.

6. The wet-coating apparatus of claim 1, wherein the cleaning agent storage bin is configured for generating ultrasonic waves.

7. The wet-coating apparatus of claim 1, wherein the coating agent storage bin comprises a pipe, the pipe is configured for charging a coating agent into and discharging the coating agent from the coating agent storage bin.

8. The wet-coating apparatus of claim 1, wherein the first hot-air injector comprises a pipe, the pipe is configured for connecting the first hot-air injector to a hot-air source.

9. The wet-coating apparatus of claim 1, further comprising a second hot-air injector located between the cleaning agent storage bin and the coating agent storage bin.

* * * * *